United States Patent [19]

Matsui et al.

[11] 3,980,140

[45] Sept. 14, 1976

[54] METHOD OF FIRE PREVENTION IN FIELDS

[75] Inventors: Takashi Matsui; Kazuo Umeda; Yujiro Nakada, all of Osaka, Japan

[73] Assignee: Kansai Nissan Chemicals Ltd., Osaka, Japan

[22] Filed: Mar. 12, 1974

[21] Appl. No.: 450,356

[30] Foreign Application Priority Data

Mar. 12, 1973 Japan ..... 48-28067

[52] U.S. Cl. ..... 169/45; 71/33; 252/8.1

[51] Int. Cl.[2] ..... A62C 3/02

[58] Field of Search ..... 252/8.1; 71/33; 169/45

[56] References Cited

UNITED STATES PATENTS

| | | | |
|---|---|---|---|
| 3,247,107 | 4/1966 | Gilchrist | 71/33 X |
| 3,249,534 | 5/1966 | Ware | 71/33 X |
| 3,459,530 | 8/1969 | Hudson | 71/33 |

OTHER PUBLICATIONS

The Condensed Chemical Dictionary, Reinhold Pub. Corp., New York, 1956, p. 672.

*Primary Examiner*—Leland A. Sebastian
*Attorney, Agent, or Firm*—Oblon, Fisher, Spivak, McClelland & Maier

[57] ABSTRACT

An aqueous fire preventing suspension is prepared by diluting a mixture of magnesium ammonium phosphate and an emulsion of a resin and a surfactant which can be sprayed onto weeds in fields in a concentration of greater than 30 wt% magnesium ammonium phosphate per weight of dried weeds.

7 Claims, 1 Drawing Figure

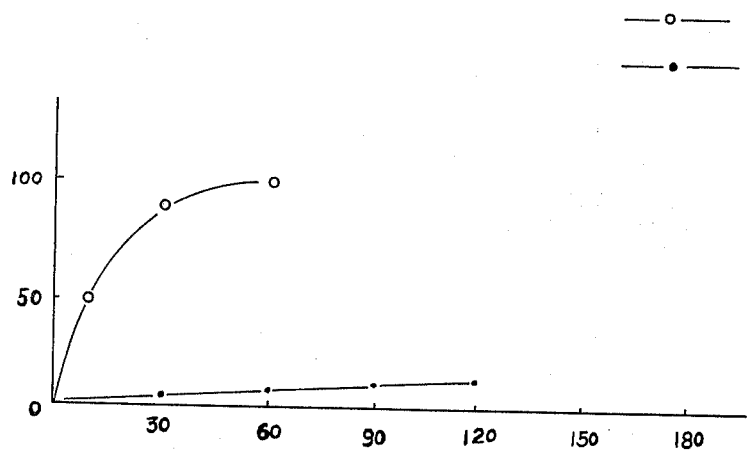
100
50
0
30
60
90
120
150
180

METHOD OF FIRE PREVENTION IN FIELDS

BACKGROUND OF THE INVENTION

1. Field of the Invention

This invention relates to a method of fire prevention in fields wherein a fire preventing aqueous suspension of magnesium ammonium phosphate is sprayed onto weeds in fields, e.g., forests, wastelands, vacant land, road side slants, especially along side of highways, whereby the extended periods of fire prevention effects are attained.

2. Description of the Prior Art

Weed fires are often caused by campfire residues or lit cigarette butts in forests, wastelands, vacant lots, road side slants or the like, and such fires have been the cause of high property damage. Heretofore, no effective method for preventing such fires has been known. It had been attempted to cut the dried weeds by hand or by a machine for fire prevention, particularly in road side slants. However, it can be quite difficult to cut down weeds and moreover, the stems and roots of the dried weeds will often remain even after the cutting, which can be fire producing.

It is known that ammonium phosphate is useful as a fire-proofing agent. However, the solubility of ammonium phosphate in water is quite high, so that, when ammonium phosphate is used as the base of a fire-proofing agent, it will be easily washed away by rain or snow after spraying. Thus, the fire prevention effect is rapidly reduced and shortlived.

It had been contemplated to use condensed phosphates, e.g., ammonium polyphosphate and a resin emulsion; however, the condensed phosphates are readily hydrolyzed by air, rain and sun-light and will also be washed down.

A need exists therefore for an effective means of reducing the fire hazard attributable to dried weeds.

SUMMARY OF THE INVENTION

Accordingly, one object of this invention is to provide a method of long-term fire prevention in fields.

Another object of this invention is to provide a method of fire prevention whereby a fire-proof agent is applied onto dried weeds, and particularly onto those weeds in road side slants or the like.

These and other objects of this invention have now been attained by the use of a suspension of magnesium ammonium phosphate, and will hereinafter become more readily understood by the following description.

DETAILED DESCRIPTION OF THE PREFERRED EMBODIMENTS

The critical component of the suspension used in this invention is magnesium ammonium phosphate which has the formula ($MgNH_4PO_4.6H_2O$). The magnesium ammonium phosphate suspension can be prepared by admixing magnesium oxide or hydroxide with an aqueous solution of ammonium phosphate. The magnesium ammonium phosphate has an average particle diameter of 0.1 – 50$\mu$, preferably 17 – 50$\mu$. The magnesium ammonium phosphate used as the base of the fire-proofing agent of this invention is characterized by a low solubility in water. A resin which is characterized by high adhesiveness and weather durability is added to the magnesium ammonium phosphate to enable the magnesium ammonium phosphate to be fixed to the dried weeds. This combined effect results in excellent fire prevention effects over extended periods of time, even under severe conditions of wind, rain, snow or heavy sunlight.

The mechanism of fire prevention of magnesium ammonium phosphate will now be explained.

The flash point of cellulose, which is the main component of dried weeds, is about 250°–300°C. However, the magnesium ammonium phosphate will discharge its water of crystallization at about 100°C and will be decomposed, discharging ammonia gas and forming magnesium pyrophosphate ($Mg_2P_2O_7$).

$$2MgNH_4PO_4.6H_2O \rightarrow Mg_2P_2O_7+2NH_3+13H_2O.$$

The magnesium ammonium phosphate contains 6 waters of crystallization ($6H_2O$) and accordingly, a cooling effect caused by the heat of vaporization of the water during the decomposition is so high, that the burning of the cellulose is prevented. Moreover, the amount of steam and ammonia gas generated in the decomposition will dilute and block the air from the surface of the dried weeds. The resulting magnesium pyrophosphate ($Mg_2P_2O_7$) is a hard, glassy, deliquescent solid which solidifies and adheres to the surface of the dried weeds, covering the surface and preventing the generation of combustible gases, such as carbon monoxide, etc. The solubility of magnesium ammonium phosphate (weight of the anhydrous compound in 100 g of the saturated solution of the compound) is 0.023 at 0°C and 0.052 at 20°C, and accordingly, the phosphate will not be dissolved away in water. When the phosphate is fixed onto the surface of the dried weeds with an emulsion of a resin which is not easily dissolved in water, the washing away of the phosphate can be substantially prevented. Suitable resins used for fixing the phosphate are the polyvinyl compounds, e.g., polyacrylate, polymethacrylate, polyvinylacetate, polyvinylalcohol, or the like. It is preferred to use vinyl acetate-acrylate copolymer having a weight ratio of 90:10 to 10:90.

The ratio of the magnesium ammonium phosphate to the resin should be selected between particular limits. When the amount of the resin is too small, the fixing of the magnesium ammonium phosphate onto the dried weeds will be too weak. When the amount of the resin is too high, the fire-proofing effect of the magnesium ammonium phosphate will be too low. It is therefore preferable to use 0.4 – 1.0 times the weight of the magnesium ammonium phosphate per weight of the resin.

A surfactant can be added to the suspension as a spreading agent. Suitable surfactants are the nonionic surfactants or anionic surfactants, although heretofore, only nonionic surfactants were permitted if ionic compounds, e.g., ammonium phosphate, was used as a base. Because the magnesium ammonium phosphate is sparingly water soluble, the fire-prevention effect of the surfactant will be slight.

The composition of the magnesium ammonium phosphate, the resin emulsion and the spreader can be in the following range.

| | |
|---|---|
| $MgNH_4PO_4.6H_2O$ | 40–100 wt parts |
| Resin in emulsion form | 100 wt parts |
| Spreader (surfactant) | 0.01–10 wt parts |

The composition of this invention can be diluted with water to provide an aqueous suspension. When the resin is maintained in an acidic condition (pH 4 – 5 in an emulsion containing 50% of the solid component) as is the case with a vinylacetate resin, magnesium ammonium phosphate may be washed away because it is soluble in the acidic solution. In order to prevent the defect of said washing away, the aqueous suspension is adjusted to pH 6.5–7 by the addition of ammonia water.

It is preferred to spray more than 30% by weight of the aqueous suspension to weight of dried weeds. (As a standard, the amount of phosphorous to cellulose in the dried weeds is considered). It is preferable to adhere the magnesium ammonium phosphate to the surface of the dried weeds in a concentration of 30 – 100 wt % to the dried weeds. Spraying of the aqueous suspension can be carried out using a nozzle mounted on a motorcar.

Having now generally described the invention, a further understanding can be obtained by reference to the following examples which are provided for purposes of illustration only, and are not to be construed as limiting of the invention unless otherwise so specified.

EXAMPLE 1

A solution of ammonium phosphate was admixed with magnesium oxide to form magnesium ammonium phosphate. An aqueous suspension of 25% by weight of magnesium ammonium phosphate was prepared by diluting with water a composition of 0.1 wt part of magnesium ammonium phosphate and 0.4 – 1.0 wt part of an emulsion of polyvinylacetate (solid component 50 wt%) and 0.01 wt part of a nonionic surfactant (polyoxyethylene nonylphenolether) and then adjusting the mixture to pH 6.5 – 7 with aqueous ammonia. The aqueous suspension of magnesium ammonium phosphate was sprayed on dried weeds (weeping-lovegrass) (Kentucky-31; Kentucky-blue-grass) in a road side slant field in a concentration of 40 wt % of the phosphate to the dried weeds. The weather durability test of the treated dried weeds was continued under natural conditions for 2 months, in the winter in Japan (Pacific Ocean side).

The result was that the residual percentage of magnesium ammonium phosphate on the dried weeds was higher than 90%, even though many rainfalls (total 132 mm) occurred during the two months. In order to test the degree of fire prevention, the dried weeds at the lower center portion of the test field (10 $m^2$) was ignited and the degree of burning was observed. The result was that the treated dried weeds were only partially burned at a rate of 0 – 0.5 $m^2$ per 60 seconds and the fire was extinguished within 60–120 seconds. However, the untreated dried weeds were found to burn rapidly after ignition and the entire field was on fire within 60 seconds. The ratio of the burned area to the burning time indicates the fire spread velocity coefficient. The results of said tests in both treated and untreated fields are shown in Table 1. The fire prevention effect of this invention can be clearly seen by this table.

TABLE 1

| | Fire spread velocity coefficient | | |
|---|---|---|---|
| | Burn [A] time (sec) | Burn [B] area ($m^2$) | Fire spread ([B]/[A]) velocity coefficient |
| Treated test field | 60 | 0 – 0.5 | 0 – 0.008 |
| Untreated test field | 60 | 10.0 | 0.167 |

FIG. 1 is a graph showing the relation of the burn time to the rate of burned area (burned area/test area × 100), that is, the rate of fire spread. As is clear from FIG. 1, the velocity of fire spread in the treated field was significantly lower than that of the untreated fields.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. A method of fire prevention in fields which comprises spraying an aqueous suspension of magnesium ammonium phosphate, a vinyl resin emulsion and a surfactant on dried weeds in the field.

2. The method of claim 1, wherein said magnesium ammonium phosphate has an average particle diameter of 0.1 – 50$\mu$.

3. The method of claim 1, wherein said aqueous suspension is 40 – 100 wt. parts of magnesium ammonium phosphate, 100 wt. parts of vinyl resin emulsion and 0.01 – 10 wt. parts of surfactant.

4. The method of claim 1, wherein said vinyl resin is vinyl acetate and the pH of said aqueous suspension is adjusted to a pH of 6.5 to 7.

5. The method of fire prevention according to claim 1, wherein the ratio of vinyl resin to magnesium ammonium phosphate is 0.4 – 1.0 by weight.

6. The method of fire prevention according to claim 1, wherein said aqueous suspension of magnesium ammonium phosphate is sprayed on dried weeds on a road side slant field.

7. A fire preventing suspension to prevent fires in dried weeds which comprises an aqueous suspension of magnesium ammonium phosphate, surfactant and vinyl resin, wherein the weight ratio of vinyl resin to magnesium ammonium phosphate is 0.4 – 1.0.

* * * * *